US006408590B1

(12) United States Patent
Cote

(10) Patent No.: US 6,408,590 B1
(45) Date of Patent: Jun. 25, 2002

(54) BREAKAWAY UTILITY POLE

(75) Inventor: Armand Cote, Leicester, MA (US)

(73) Assignees: Armand G. Cote, Jr., Leicester; Armand G. Cote, III, Whitinsville, both of MA (US)

( * ) Notice: Subject to any disclaimer, the term of this patent is extended or adjusted under 35 U.S.C. 154(b) by 0 days.

(21) Appl. No.: 09/140,049

(22) Filed: Aug. 26, 1998

Related U.S. Application Data

(60) Provisional application No. 60/056,431, filed on Aug. 25, 1997.

(51) Int. Cl.[7] ..... E04C 3/30

(52) U.S. Cl. ..... 52/726.4; 52/732.3; 52/98; 248/545; 248/548; 248/900

(58) Field of Search ..... 52/726.4, 732.3, 52/98, 736.3, 736.4, 737.4, 737.5, 738.1, 732.1; 404/6; 248/548, 900, 545, 159

(56) References Cited

U.S. PATENT DOCUMENTS

| | | | | | |
|---|---|---|---|---|---|
| 415,324 | A | * | 11/1889 | Greene | 52/726.4 |
| 1,805,253 | A | * | 5/1931 | Nadel | 52/737.5 X |
| 3,325,950 | A | * | 6/1967 | Pfaff | 52/726.4 X |
| 3,378,967 | A | * | 4/1968 | Baumeister | 52/98 |
| 3,713,262 | A | * | 1/1973 | Jatcko | 52/98 |
| 4,630,413 | A | * | 12/1986 | Svensson | 52/98 |
| 4,738,058 | A | * | 4/1988 | Svensson | 52/98 |
| 5,081,804 | A | * | 1/1992 | Andersson et al. | 52/726.4 X |
| 5,160,111 | A | * | 11/1992 | Hugron | 52/98 X |
| 5,775,035 | A | * | 7/1998 | Papin | 52/726.4 X |
| 5,860,253 | A | * | 1/1999 | Lapointe | 52/98 |

FOREIGN PATENT DOCUMENTS

| | | | | |
|---|---|---|---|---|
| CA | 693708 | * | 9/1964 | 52/726.4 |
| JP | 6257324 A | * | 9/1994 | 52/726.4 |

* cited by examiner

*Primary Examiner*—Carl D. Friedman
*Assistant Examiner*—Brian E. Glessner
(74) *Attorney, Agent, or Firm*—Mirick, O'Connell, DeMallie & Lougee, LLP

(57) ABSTRACT

A breakaway utility pole preferably made from plastic material. The pole includes a first portion buried in the ground and protruding therefrom. A second elongated portion is interfitted into the first portion above the ground, and is designed to fracture upon impact by a car or truck. The pole includes an upper portion, interfitted into the second portion, and which carries the utility wires. When the second portion is fractured, it can be removed and replaced.

9 Claims, 6 Drawing Sheets

BREAKAWAY UTILITY POLE

CROSS REFERENCE TO RELATED APPLICATION

This application claims priority of Provisional application serial No. 60/056,431, filed on Aug. 25, 1997.

FIELD OF THE INVENTION

This invention relates to a plastic utility pole which breaks on impact by an automobile, to decrease the likelihood of injury or property damage.

BACKGROUND OF THE INVENTION

Utility poles line many streets throughout the United States. These poles are typically made from trees, and the lower portions of the poles which are set in the ground are treated with a substance such as creosote to inhibit rotting and water and insect damage. There are numerous problems associated with such utility poles. For one, the poles are extremely rigid, and contribute greatly to bodily injury and property damage caused when vehicles strike the poles. Also, these poles use relatively large trees, which are more and more scarce, and could be used for other applications. Additionally, the trees often must be transported great distances, adding to their cost. Another consideration is the length of the poles, which makes their transport even more difficult. Finally, the creosote from the poles can enter the ground and cause pollution.

SUMMARY OF THE INVENTION

It is therefore an object of this invention to provide a utility pole which decreases the likelihood and occurrence of bodily injury and property damage when struck by a vehicle.

It is a further object of this invention to provide such a utility pole which uses recycled material, particularly plastic.

It is a further object of this invention to provide such a utility pole which is extremely long-lasting and is not subject to decay, water or insect damage, or fire damage.

It is a further object of this invention to provide such a utility pole which does not contribute to pollution in the ground.

It is a further object of this invention to provide such a utility pole which is easy to transport and install.

It is a further object of this invention to provide such a utility pole which does not deplete forest resources.

It is a further object of this invention to provide such a utility pole which does not have to be transported great distances.

This invention results from the realization that such a utility pole can be made by fabricating the pole from plastic material, in a number of separate sections which are fit together on site to form the pole, and in which the section just above the ground and up to a height which could be struck by a vehicle, is made to be relatively weak when subjected to an impact, so that the pole will break and thus inhibit bodily injury and property damage.

BRIEF DESCRIPTION OF THE DRAWINGS

Other objects, features and advantages will occur to those skilled in the art from the following description of the preferred embodiments, and the accompanying drawings, in which.

DESCRIPTION OF THE PREFERRED EMBODIMENTS

This invention may be accomplished in a breakaway utility pole which includes a first elongated pole portion buried in the ground and protruding therefrom, a second elongated pole portion interfitted into the first portion above the ground, and a means for hanging utility wires from the pole. Most or all of the pole is preferably made from a plastic material which can be extruded, such as recycled high density polyethylene.

Figure 1:
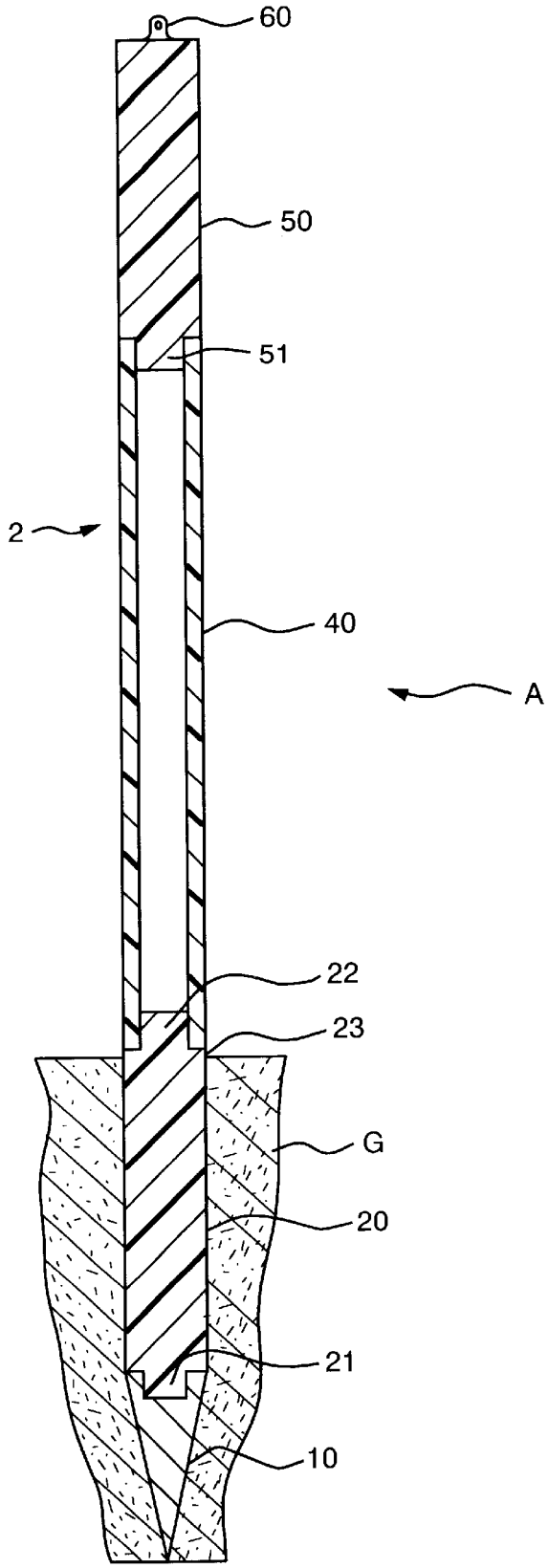
FIG. 1 is a cross-sectional view of a preferred embodiment of the utility pole of this invention.
Figure 2A:
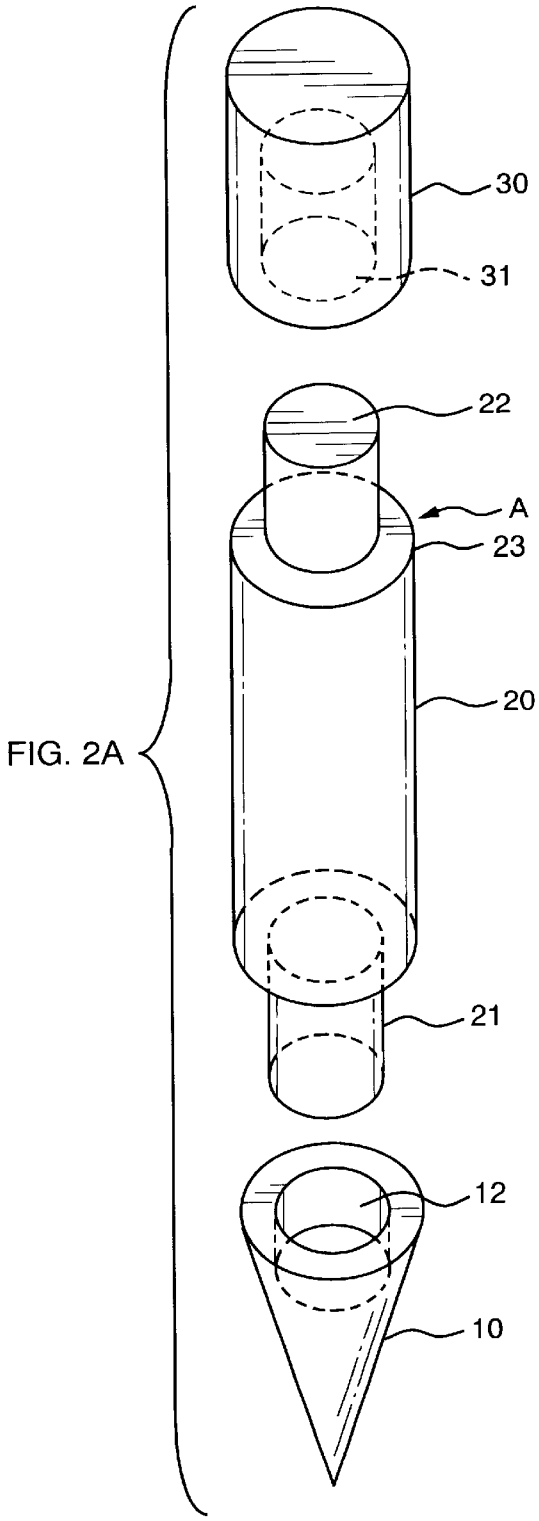
FIG. 2 is an exploded view of the pole of FIG. 1.
Figure 2B:
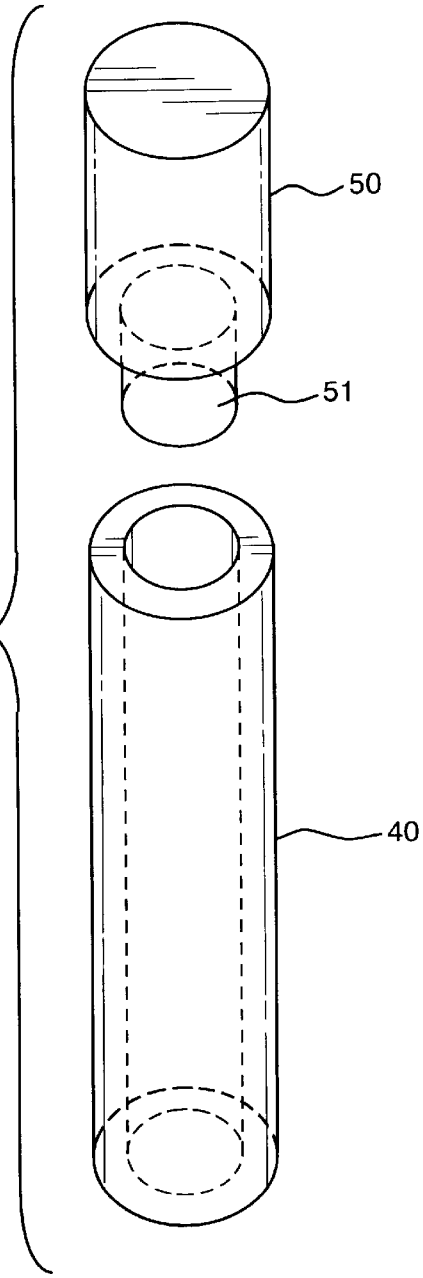

A preferred embodiment of utility pole 2 of this invention is shown in FIGS. 1 and 2. Pole 2 includes first elongated pole portion 20 which is preferably a solid or substantially solid cylindrical plastic member with protruding male ends 21 and 22. Portion 20 is buried in the ground G such that it protrudes from the ground only slightly, perhaps 2 inches. This embodiment also includes optional steel point section 10 which assists the placement into the ground of portion 20, as described below.

Figure 4:
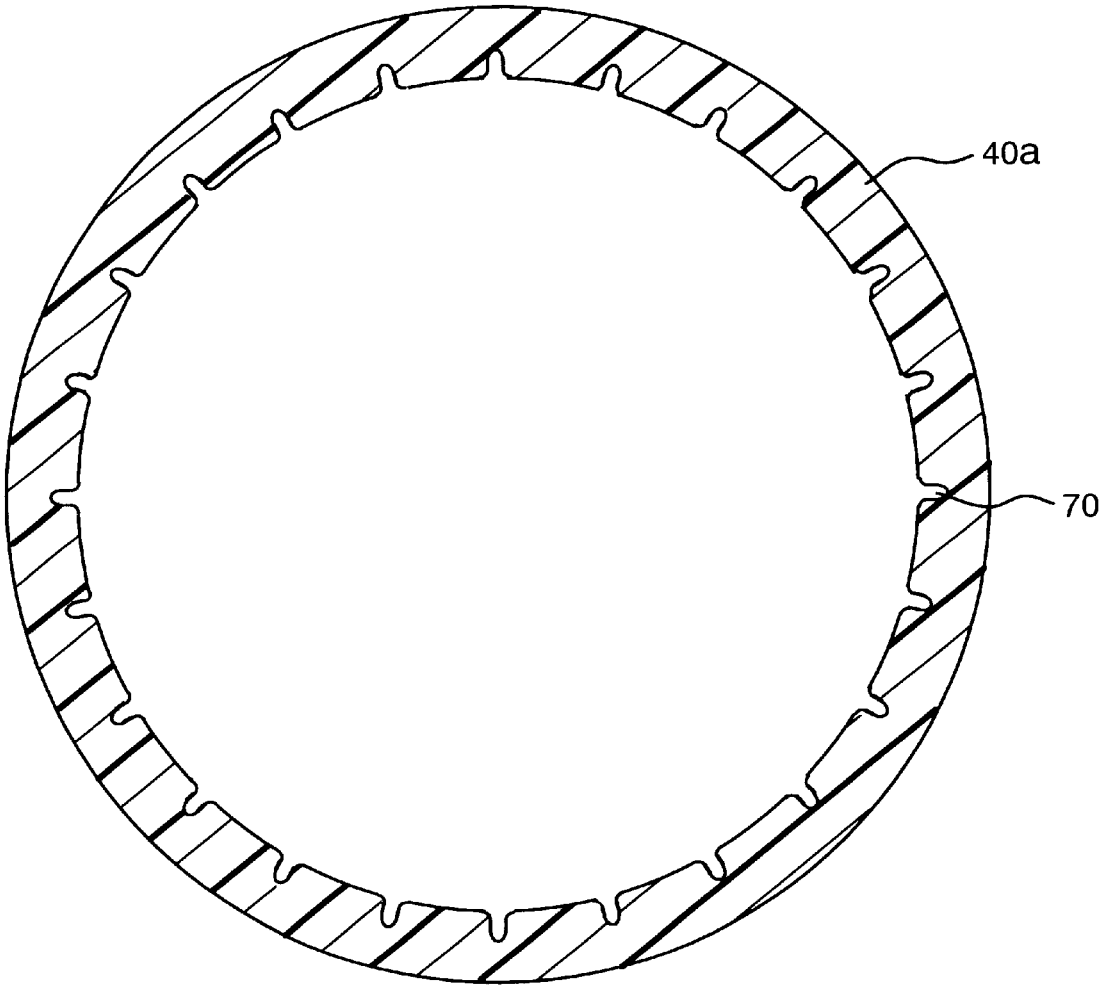
FIG. 4 is a cross sectional view of a preferred form of the intermediate portion of the utility pole of this invention.

Second elongated pole portion 40 is interfitted into portion 20 above the ground. portion 40 is made to fracture or bend relatively easily when struck by a substantial force in the perpendicular direction indicated by arrow A. The force and the resulting action can be designed as desired. For example, portion 40 may be designed to fracture on impact by a car of average weight traveling at 20 miles per hour. This result is accomplished by a combination of materials and construction. In the embodiment shown in FIGS. 1 and 2, portion 40 is an extruded cylindrical tube with an appropriate wall thickness to accomplish this result. The walls of portion 40 can have a desired, designed further weakness by including vertical fluting 70 shown in the cross-sectional view of alternative portion 40*a*, FIG. 4. Other equivalent means of creating a desired impact strength of portion 40 are encompassed within the scope of the invention. Portion 40 has a length which is sufficient to span most or all of the vertical height at which a utility pole might be struck by a car or truck, which is expected to be something on the order of 10 feet. Thus, when the pole is struck with sufficient force, portion 40 fractures, which inhibits personal injury and property damage.

Figure 3:
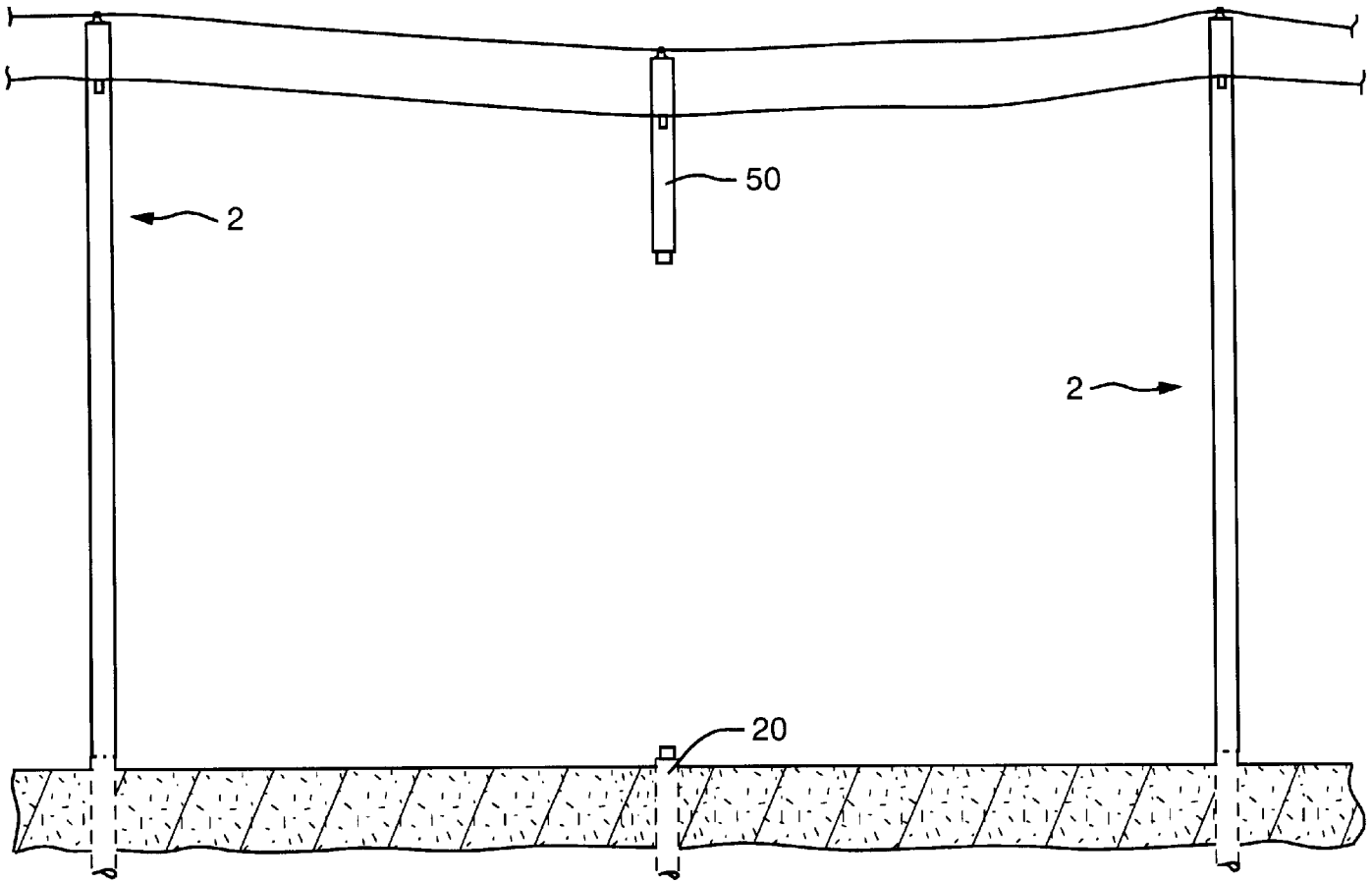
FIG. 3 is a simplified, schematic view of three poles of FIG. 1, showing one pole with its intermediate portion broken away.

Pole 2 also includes upper plastic portion 50 which is the wire bearing portion of the pole. Portion 50 is preferably a solid or substantially solid plastic member which can accept appropriate wire bearing hardware such as is well known in the art. Eyelet 60 accepts a cable which passes therethrough and to adjacent poles, shown in FIG. 6, which prevents portion 50 from falling to the ground if portion 40 is fractured. Such is shown in FIG. 3.

Portions 20, 40 and 50 can be interfitted by any convenient means which allows them to be assembled on site (or after production and before installation), and which allows the replacement of intermediate portion 40. In the preferred embodiment, such is accomplished with protruding male ends on portions 20 and 50 which fit into the hollow center of portion 40. Other means of accomplishing this result are also encompassed within the invention.

Figure 5:
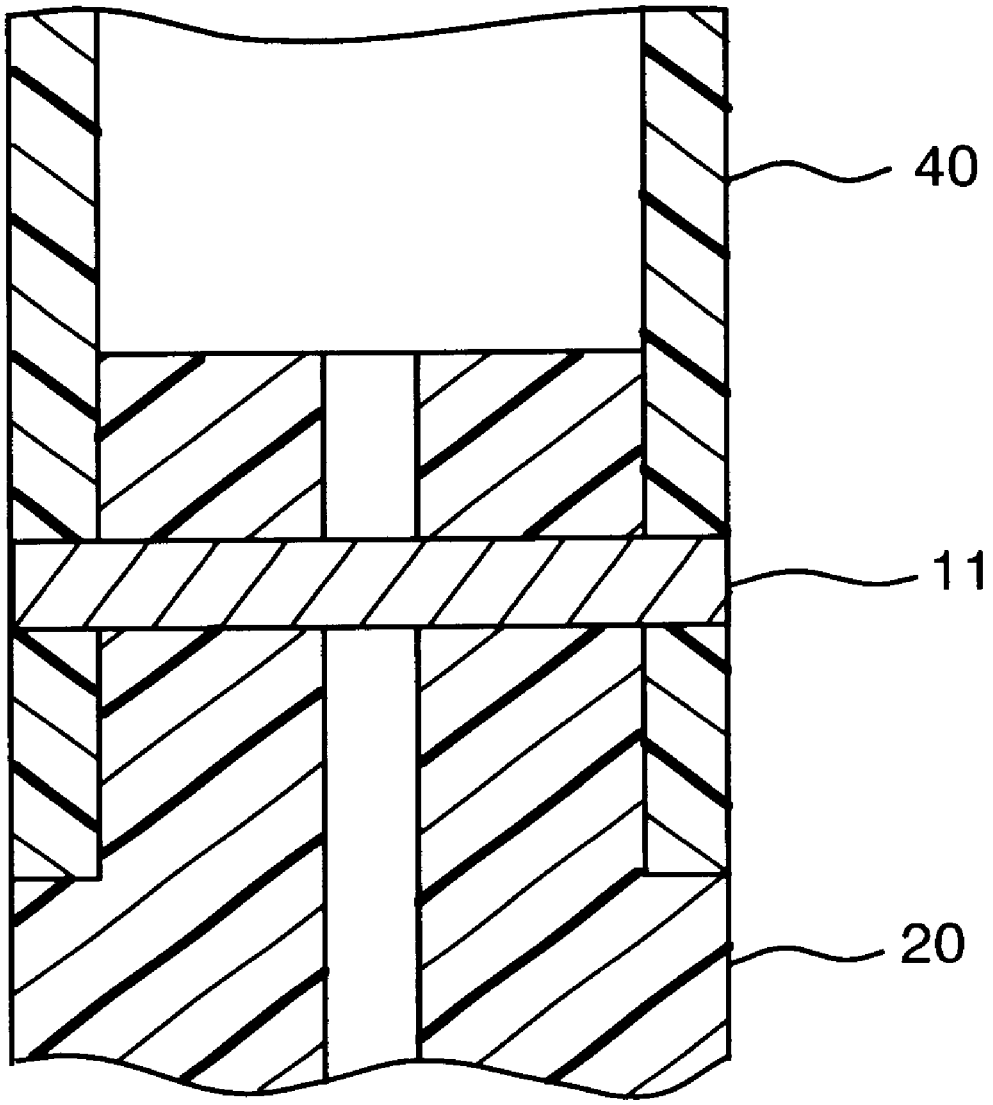
FIG. 5 is a detailed, partial, cross-sectional view of one manner of securing two portions of the utility pole of this invention.
Figure 6:
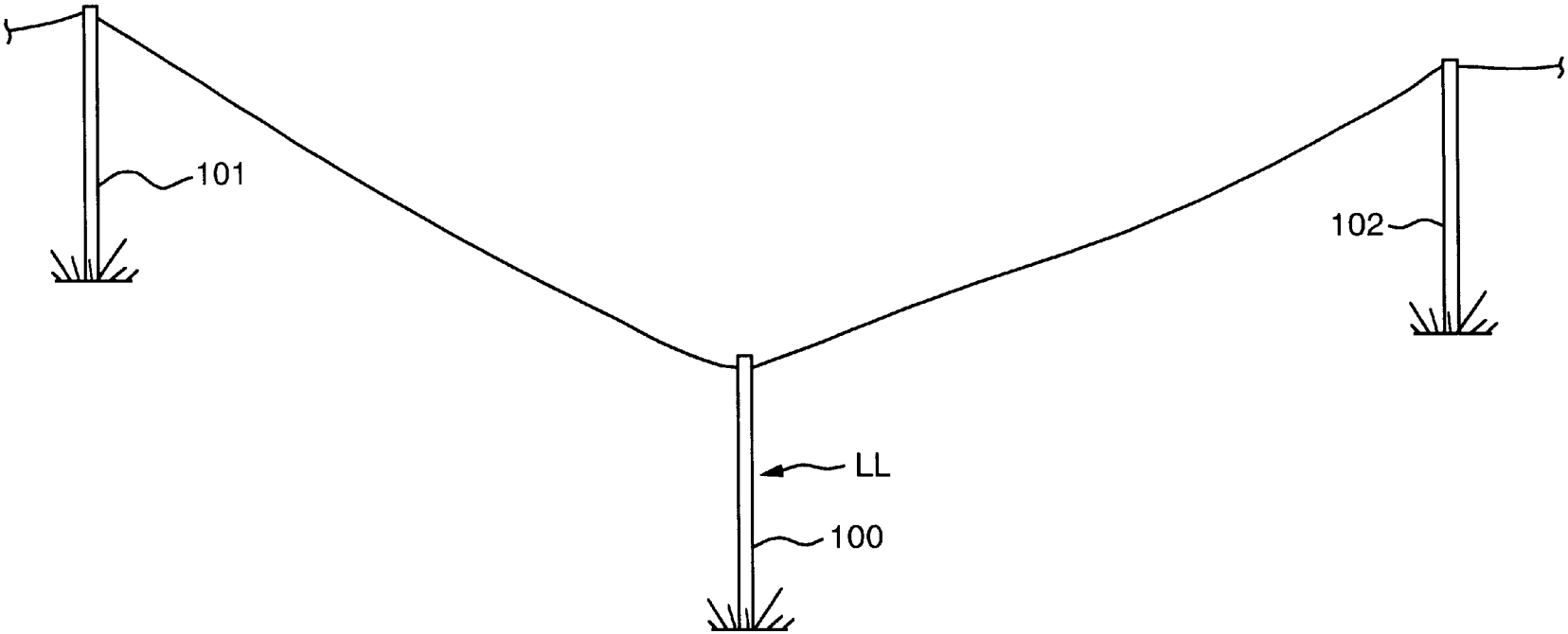
FIG. 6 is an illustration of the need for the structure shown in FIG. 5.

In situations in which the poles are not at the same height, for example with lower pole 100, FIG. 6, there must be included some means for maintaining the pole portions together when the pole is in tension. One solution is shown in FIG. 5, in which steel pin 11 is inserted through portions 20 and 40. Since pin 11 will tend to keep these portions together, it must be removable and replaceable in order to allow replacement of portion 40 if it is bent or broken.

The pole of FIGS. 1 and 2 may be erected as follows. Steel point 10 is interfitted to portion 20 by inserting protruding male end 21 into opening 12 in the top of point 10. Steel cap 30 with opening 31 which accepts male end 22 of portion 20, is placed over end 22 and sits on top surface 23 of portion 20. Cap 30 allows point 10 and portion 20 to be driven into the ground to the desired depth. Cap 30 is then removed, and can be reused for another installation. Portion 40 is then placed over end 22. Crown 50 has male end 51 which also fits in the center cavity of portion 40. Crown 50 can be interfitted into portion 40 either before or after portion 40 is placed over end 22 of portion 20. The utility wires are then hung from crown and a cable is run from crown 50 to the adjacent poles.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A plastic breakaway utility pole, comprising:

a solid, plastic lower member for embedding in the group and having a connector at its top, protruding from the ground;

an intermediate hollow, plastic generally cylindrical member interfitted into said lower member connector and protruding up, and having a connector at its top; and a solid plastic top member interfitted into said intermediate member connector, and having means for carrying utility wires;

wherein said intermediate member is a hollow plastic tube which is adapted to fracture upon a relatively low impact from an automobile.

2. The breakaway utility pole of claim 1 in which said intermediate member is internally fluted along its length weaken it so that it fractures more easily.

3. The breakaway utility pole of claim 1 in which said second portion is generally annular in cross-section.

4. The breakaway utility pole of claim 1 in which said lower member includes at its upper end one part of a two-part male/female connector element.

5. The breakaway utility pole of claim 4 in which said intermediate member includes at its lower end the second part of said male/female connector element.

6. The breakaway utility pole of claim 5 in which said intermediate member further includes at its upper end one part of another two-part male/female connector element.

7. The breakaway utility pole of claim 6 in which said top member includes the second part of said another two-part male/female connector element.

8. The breakaway utility pole of claim 1 in which said lower, intermediate and top members are generally cylindrical.

9. The breakaway utility pole of claim 8 further including a pointed member into which said lower member fits.

* * * * *